US006024660A

United States Patent [19]

Romanick

[11] Patent Number: 6,024,660

[45] **Date of Patent: *Feb. 15, 2000**

[54] SPORTS BALL THROWING TRAINING DEVICE

[76] Inventor: Ron Romanick, 16028 E. Sunflower Dr., Fountain Hills, Ariz. 85268

[ * ] Notice: This patent is subject to a terminal disclaimer.

[21] Appl. No.: 09/132,578

[22] Filed: Aug. 11, 1998

[51] Int. Cl.[7] ..... A63B 37/14

[52] U.S. Cl. ..... 473/596; 473/451

[58] Field of Search ..... 473/353, 424, 473/451, 458, 596, 233, 597, 615, 570, 571, 576, 465, FOR 111, FOR 134, FOR 162, FOR 166, 234, 514, 422; 273/402, 412, 453, DIG. 19, 142 H; 446/243, 736, 484, 236

[56] References Cited

U.S. PATENT DOCUMENTS

| | | | |
|---|---|---|---|
| 2,127,433 | 8/1938 | Sky | 473/234 |
| 2,215,899 | 9/1940 | Beasley . | |
| 2,388,463 | 11/1945 | Benecke | 473/233 |
| 2,935,321 | 5/1960 | Lhotka | 473/558 |
| 2,953,378 | 9/1960 | Veigne | 473/615 |
| 3,152,802 | 10/1964 | Sain, Jr. | 473/424 |
| 3,202,424 | 8/1965 | Patterson | 473/514 |
| 3,897,068 | 7/1975 | Staples | 473/233 |
| 4,014,545 | 3/1977 | Keim | 473/465 |
| 4,309,038 | 1/1982 | Spoon | 473/596 |
| 4,325,549 | 4/1982 | Vasselli . | |
| 5,045,014 | 9/1991 | Harkins | 446/236 |
| 5,222,738 | 6/1993 | Muller | 273/142 H |
| 5,265,871 | 11/1993 | Hanley | 473/516 |
| 5,375,848 | 12/1994 | Coleman | 473/514 |
| 5,447,314 | 9/1995 | Yamazaki | 473/352 |
| 5,480,154 | 1/1996 | Barnhill | 473/352 |
| 5,522,597 | 6/1996 | Hanks | 273/142 H |
| 5,542,660 | 8/1996 | Cione | 473/596 |
| 5,564,698 | 10/1996 | Honey | 473/352 |
| 5,582,550 | 12/1996 | Foley | 473/352 |
| 5,615,879 | 4/1997 | Bailey | 473/234 |
| 5,626,531 | 5/1997 | Little | 473/352 |
| 5,830,091 | 11/1998 | Romanick | 473/596 |

*Primary Examiner*—Raleigh W. Chiu
*Attorney, Agent, or Firm*—Snell & Wilmer L.L.P.

[57] ABSTRACT

The present invention includes a training aid for providing an audible or visual indication of a properly thrown sports ball. The device preferably includes an elongated hollow, tubular member with closed ends and an inner dowel which is freely moveable longitudinally within the hollow tube. The ends of the hollow tube in the preferred embodiment can alternatively include plugs, weights, magnets, or bolts, thereby allowing the device to be adjusted or changed for varying levels of sound, weight, resistance, release points or other training needs. One end of the tubular member preferably includes an upwardly curving handle replicating the lower end of a sports ball, and an upper curved handle is located at a predetermined distance from the lower handle, replicating the top of the sports ball. The upper curved handle is preferably adjustable along the length of the tubular member, thereby allowing with the same device, the distance between the handles to be increased or decreased to replicate various sized sports balls, namely a baseball, softball, football, and/or the like. Alternatively, one end of the tubular member can be inserted into a replicated or actual sports ball (or attached to the outside of a sports ball) so the athlete is able to grasp the sports ball with his or her proper grip. Alternatively, the device includes an elongated rod with beveled ends and an outer ring which circumscribes the rod and is freely moveable longitudinally along the outside of the rod. Alternatively, the device can consist of an electric circuit, external or internal to the ball, in which the mercury switch acts like the dowel in the preferred embodiment.

20 Claims, 6 Drawing Sheets

SPORTS BALL THROWING TRAINING DEVICE

RELATED REFERENCES

This application is related to, and claims the benefit of, U.S. patent application Ser. No. 08/974,082 filed on Nov. 19, 1997 by Ron Romanick, now U.S. Pat. No. 5,830,091, issued on Nov. 3, 1998.

FIELD OF THE INVENTION

The present invention relates, generally, to a sports ball throwing training device, and more particularly, to a method and apparatus for audibly or visually indicating proper throwing mechanics.

BACKGROUND OF THE INVENTION

The sporting industry is a multi-billion dollar industry with participants of all skill levels. With the continued expansion of the sporting industry, competition among athletes has intensified. Thus, the need to become a better athlete is usually imperative for being drafted onto a sports team, winning competitive events, and improving personal goals. To become a better athlete, a participant typically practices to fine-tune every aspect of his or her sporting experience, namely improving form, mechanics, strength, speed and accuracy.

When a person throws a sports ball, such as a baseball, softball, football and/or the like, the person typically uses a circular arm motion whereby the arm is stretched backwards, then over the shoulder, and finally a strong, accelerated forward circular motion followed by the athlete releasing the ball with a strong snapping of the wrist. Alternatively, in other sports such as softball, a circular arm motion occurs, but in the underhand direction. In any related sport, the proper positioning of the arm and wrist is usually a major factor in delivering a more powerful, more controlled, and more accurate throw. Aside from physical conditioning and strength, the techniques used to throw a ball, including the precise rotation for release of the ball is a difficult skill which many athletes require many hours of training to perfect. Thus, a simplified device is needed as a training aid for instructing athletes on the proper throwing technique which teaches muscle memory that leads to an improved arm circle and maximum power, control, speed and accuracy.

An athlete could practice the proper throwing motion by throwing a sports ball such as a baseball, repeatedly until improved technique is achieved. However, the repeated throwing of a baseball typically causes muscles to tire and other more severe medical problems over time. Additionally, an injured athlete or handicapped individual may not be able to properly throw a baseball. Moreover, the throwing of baseballs for practice requires retrieval and a large outdoor field in which to practice. Furthermore, many devices exist for training athletes on the proper throwing technique; however, the devices are typically only applicable to one sport or one type of sports ball. Other devices exist for the training of the proper swinging technique for golf or baseball swings, but these devices are limited to the training of an optimum swing and the training of the optimum point for impact against the ball. Thus, a training aid is needed for improving throwing technique in an indoor or outdoor location without substantially increasing the potential for medical injury from repeated use.

SUMMARY OF THE INVENTION

The present invention includes a training aid for providing an audible or visual indication of a properly thrown sports ball. The preferred embodiment includes an elongated hollow, tubular member with closed ends and an inner dowel which is freely moveable longitudinally within the hollow tube. The ends of the tubes can alternatively include plugs, weights, magnets, or bolts, thereby allowing the device to be adjusted or changed for varying levels of sound, weight, resistance, release points or other training needs. An alternative embodiment includes an elongated rod with beveled ends and a ring which circumscribes the outside of the rod and is freely moveable longitudinally along the outside of the rod from one end of the rod to the other. One end of the elongated rod/tube includes an upwardly curving handle replicating the lower end of a sports ball, and an upper curved handle is located at a predetermined distance from the lower handle, replicating the top of the sports ball. The upper curved handle is preferably adjustable along the length of the elongated rod/tube, thereby allowing with the same device, the distance between the handles to be increased or decreased to replicate various sized sports balls, namely a baseball, softball, football, and/or the like. Alternatively, one end of the elongated rod/tube can be inserted into a replicated or actual sports ball (or attached to the outside of a sports ball) so the athlete is able to grasp the sports ball with his or her proper grip.

When in use, the athlete grabs the lower end of the elongated rod/tube, either around the curved handles or around the replicated or actual sports ball, and proceeds to rotate his or her arm in a circular motion, thereby replicating a throwing motion. During the rotation of the arm, the inner dowel or outer ring remains substantially stationary at one end of the elongated rod/tube, thereby indicating the proper throwing technique. When a predetermined point is reached during the throwing motion, the athlete will snap his or her wrist to replicate the optimum release point. When the wrist is snapped, the centrifugal force acts upon the inner dowel or outer ring, thus forcing the dowel or ring to travel longitudinally within the hollow tubular member or along the outside of the rod, and eventually impacting the upper end of the elongated rod/tube, resulting in an audible indication of the changed wrist location. During an incorrect throwing technique, the dowel or ring will not move at all or will impact the upper end of the elongated rod/tube at an earlier point, giving the athlete an audible signal to make the athlete aware of an inaccurate throw.

Another embodiment provides a visual indication rather than an audible indication of when the wrist snap has occurred. This embodiment includes a simple electronic circuit comprising of a battery, a mercury switch, a light emitting diode (LED), a resistor and/or other similar basic components. The LED is not switched on unless the mercury switch completes the circuit and allows current to pass from the batter to the LED. The mercury will act in a similar manner to the dowel in the preferred embodiment. When the wrist is snapped, the centrifugal force will push the mercury to the outer end of the device and complete the circuit. Alternatively, this electrical circuit could be used to create an audible indication by replacing the LED with a speaker or a similar device.

BRIEF DESCRIPTION OF DRAWING FIGURES

The present invention will now be described in connection with the appended drawing figures, wherein like numerals represent like elements, and:

DETAILED DESCRIPTION OF PREFERRED EXEMPLARY EMBODIMENTS

The present invention preferably includes a sports ball throwing training aid device which creates an audible or visual warning during a practice throw (whereby the ball is not released in the preferred embodiment), indicating a proper or improper wrist positioning depending on the phase of the throw when the audible or visual indication occurs. With respect to FIG. 1, a cross-sectional view of the overall device in accordance with a preferred embodiment of the present invention is shown. This preferred embodiment includes, generally, a hollow tubular member 12 having an inner dowel 40 which travels longitudinally freely along the inside of hollow tubular member 12. One end of hollow tubular member 12 includes a means for gripping one end of tubular member 12 to replicate the gripping of a sports ball, namely, a baseball, softball, football, and/or the like. One of ordinary skill in the art will appreciate that the present invention can also be used for other non-sport activities which require similar movements.

Figure 1:
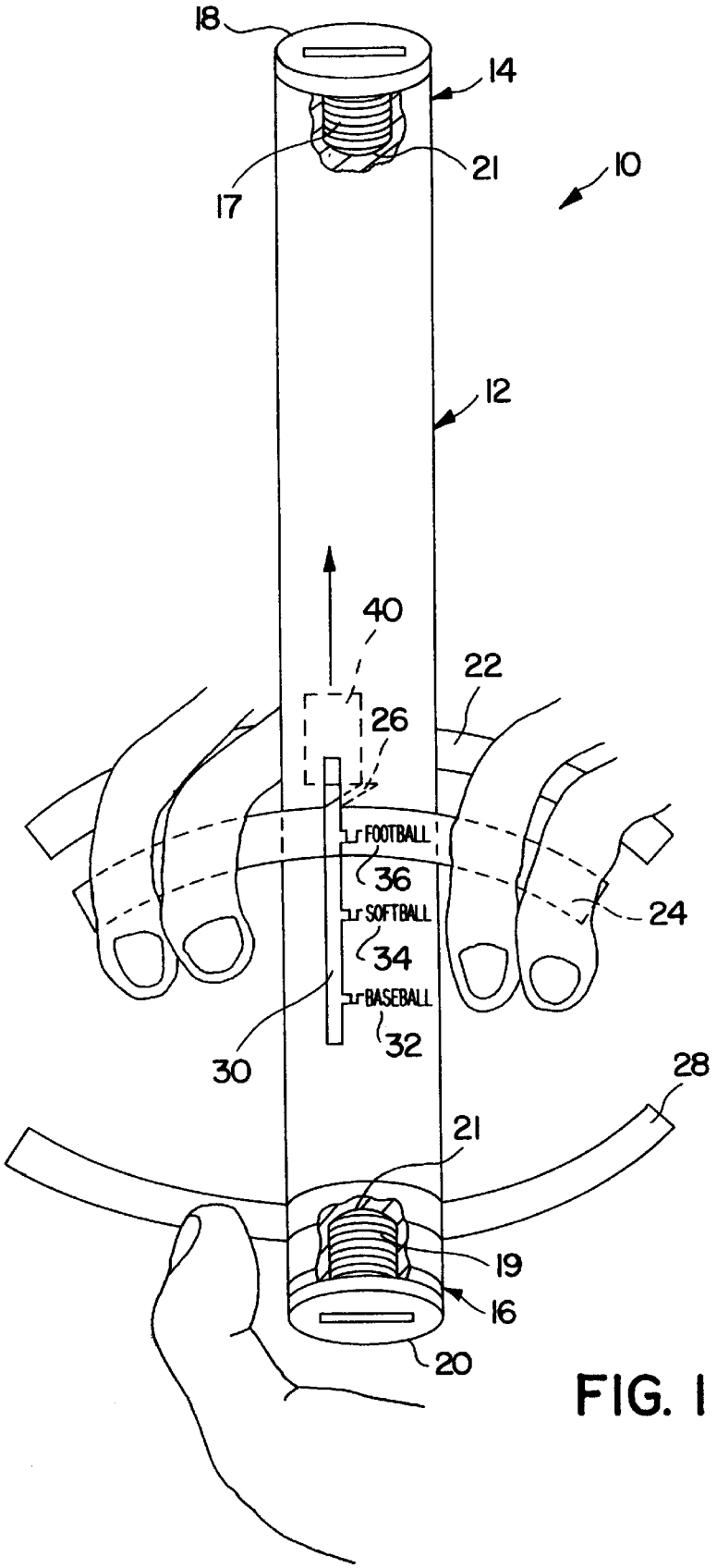
FIG. 1 shows a partial cut away view of a preferred embodiment in accordance with the present invention.

More particularly, with continued reference to FIG. 1, hollow tubular member 12 of throwing device 10 is preferably a metal tube of about 18 inches in length and about one inch in diameter. One of ordinary skill in the art will appreciate that tubular member 12 can be of any size, material or shape which can be incorporated into the present invention to yield substantially similar results. For example, tubular member 12 can be formed of a suitable plastic or metal alloy. Additionally, tubular member 12 can be filled with any liquid or other material which would alter the friction surrounding dowel 40.

Tubular member 12 preferably includes a first end 14 and a second end 16. Both ends 14, 16 preferably include weighted bolts 18, 20, respectively, in threaded engagement with ends 14, 16. In alternative embodiments, ends 14, 16 include any suitable device for closing off the hollow tubular member at one or both its ends, 14, 16. For example, tubular member 12 can be fabricated with permanently closed ends such as by soldering or the like, bolts of different weights, materials and sizes inserted into both ends, magnets inserted into both ends and/or the like. In a further alternative embodiment, bolts 18, 20 include a hard rubber material 21 coated on the inner end of bolts 18, 20 to suitably provide for shock absorption upon impact by inner dowel 40. In a preferred embodiment, a threaded engagement 17, 19 is used, thereby allowing for bolts 18, 20 to be easily removed and changed with bolts having different features including decreased or increased weight, magnetism and/or the like. In practice, an experienced trainer will typically adjust the weight of one or both bolts 18, 20 to assist in muscle development or for rehabilitation purposes.

A small dowel 40 is preferably located within hollow tubular member 12 such that dowel 40 freely moves longitudinally along the inside cavity within tubular member 12. Dowel 40 is preferably a solid metal element, but one of ordinary skill in the art will appreciate that dowel 40 can be an element of any size or shape which is capable of traveling longitudinally within tubular member 12. For example, dowel 40 can be a spherical ball. One of ordinary skill in the art will also appreciate that dowel 40 can be any suitable material, including metal, metal allow, plastic, magnetized material, and/or the like.

With continued reference to FIG. 1, second end 16 of tubular member 12 preferably includes a means for replicating a sports ball. In a preferred embodiment, an upwardly curving metallic handle 28 is suitably attached to end 16. Handle 28 preferably provides a lower gripping point for the thumb when device 10 is in use. One of ordinary skill in the art will appreciate that handle 28 can be of any suitable curvature, shape, material and/or the like. For example, handle 28 can be a circular plate attached to end 16 of tubular member 12. In an alternative embodiment, handle 28 includes a circular ring 29 which is suitably reciprocally received around end 16 such that handle 28 can be suitably slid along tubular member 12 and be located at any position along tubular member 12. Circular ring 29 alternatively includes a threaded inner surface such that handle 23 can be simply rotated (similar to a known wing nut) to adjust the distance between handle 28 and upper handle 22,24. Adjustable handle 28 allows device 10 to be adaptable to different hand sizes and comfort levels.

In a preferred embodiment, upper curved dual handles 22,24 are located at a predetermined distance from end 16, thereby providing support for the fingers when gripping device 10 during a throwing motion. Upper handles 22,24 are preferably located on opposite sides of tubular member 12 and connected by a perpendicular element 26, thereby forming an "H" type configuration. Perpendicular member 26 connects handles 22, 24 by being located within narrow, rectangular openings 30 which are aligned, but located on opposite sides of tubular member 12. The sides of rectangular openings 30 include indicia 32, 34, 36 indicating predetermined distances for fixing upper handles 22, 24 away from lower handle 28. The predetermined distances 32, 34, 36 replicate the diameters of a baseball, softball, and football, respectively. One of ordinary skill in the art will appreciate that the diameter of any size ball can be replicated with the present configuration of handles 22,24 and 28. Upper handles 22, 24 are preferably temporarily fixed at the predetermined locations 32, 34, 36 by any suitable means for temporarily latching handles 22, 24 to tubular member 12. In a preferred embodiment, a notch is located at each distance, 32, 34, 36 and perpendicular cross member 26 simply fits within the selected notch. In an alternative embodiment (not shown), upper handles 22, 24 are replaced by a single handle fixedly attached to a predetermined point on handle 12. In this embodiment, the adjustability of lower handle 28 (as described above) preferably serves as the means for adjusting the distance between the handles. In another alternative embodiment (not shown), upper handles 22, 24 are replaced by a handle having a circular ring (similar to handle 28 described above) which is suitably reciprocally received around tubular member 12 such that the handle can be suitably slid along tubular member 12 and be located at any position along tubular member 12. Circular ring alternatively includes a threaded inner surface such that handle 23 can be simply rotated (similar to a known wing nut) to adjust the distance between handle 28 and upper handle 22,24.

Figure 2:
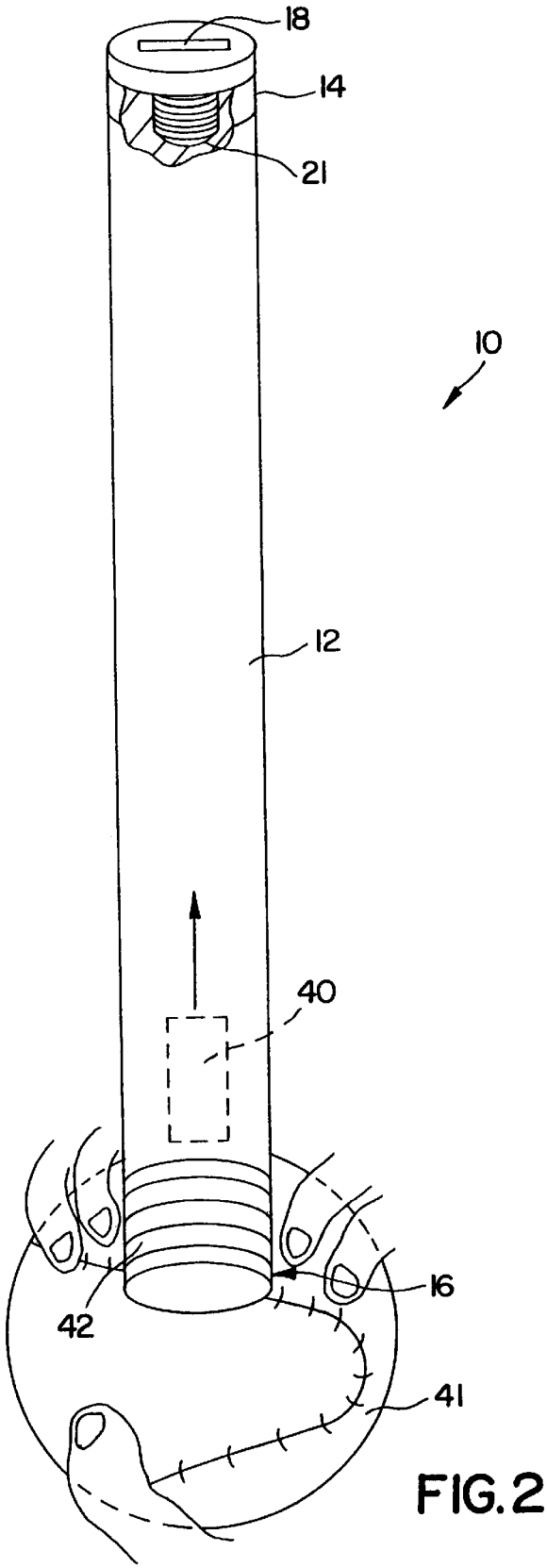
FIG. 2 shows an overall view of an alternative embodiment in accordance with the present invention.

With reference to FIG. 2, in an alternative embodiment, one or both of upper handles 22, 24 and lower handle 28 are eliminated and an actual sports ball 41, or replica of a sports ball, is fixedly attached to end 16 of tubular member 12. In a preferred embodiment, end 16 of tubular member 12 is reciprocally received within the sports ball. End 16 preferably includes a threaded outer surface capable of threadedly receiving a ball 41. Ball 41 preferably includes a bored out hole 42 having a threaded inner surface. Threaded end 16 allows for various replicated sports balls 41 (football, softball, etc.) having a bored out opening 42 to be easily temporarily connected to end 16 thereby increasing the versatility of device 10.

Figure 3:
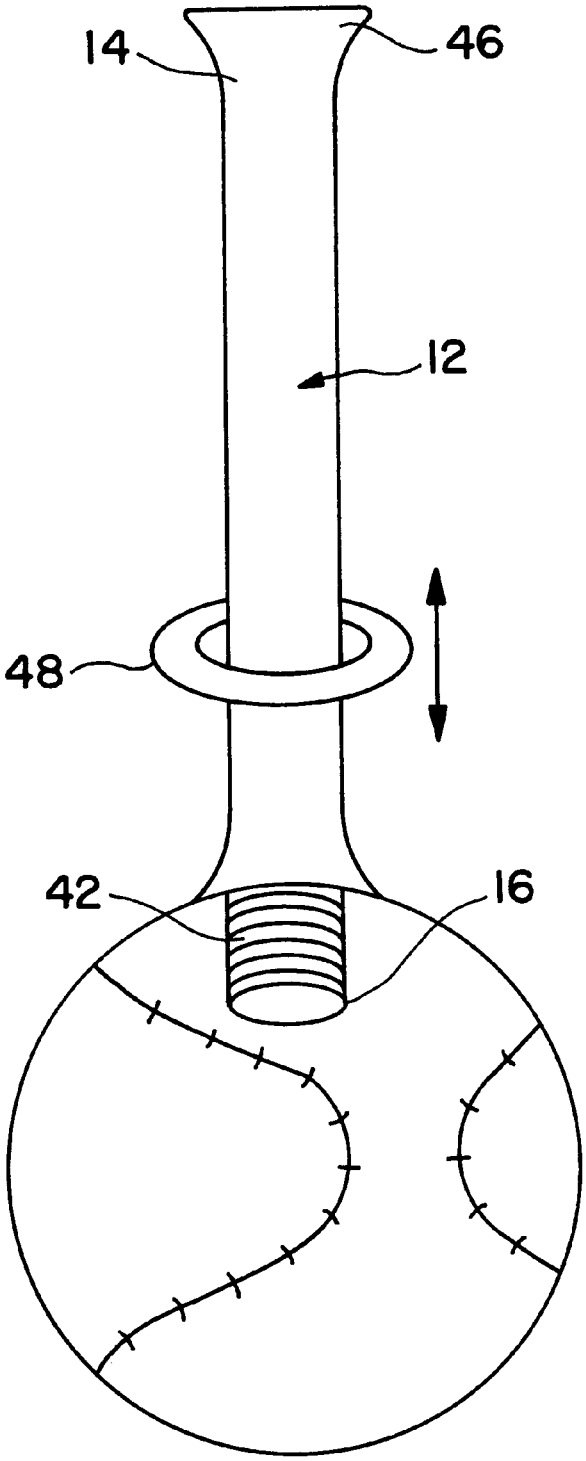
FIG. 3 shows an overall view of another alternative embodiment, namely a ring on a rod, in accordance with the present invention.

With reference to FIG. 3, in an alternative embodiment, the device consists of an elongated rod 12 with a beveled portion 46 on first end 14 and a freely moving ring 48 which circumscribes elongated rod 12. Ring 48 acts like dowel 40 in the preferred embodiment and impacts the beveled portion 46 of first end 14 when the athlete's wrist is properly snapped. Alternatively, beveled portion 46 of first end 14 could be replaced by any suitably similar design or device which stops the ring from leaving the device and creates an audible indication when ring 48 impacts first end 14. For example, first end 14 could include a bolt with an enlarged head which simply threads into threaded hole 17 (see FIG. 1).

Figures 1, 4B:
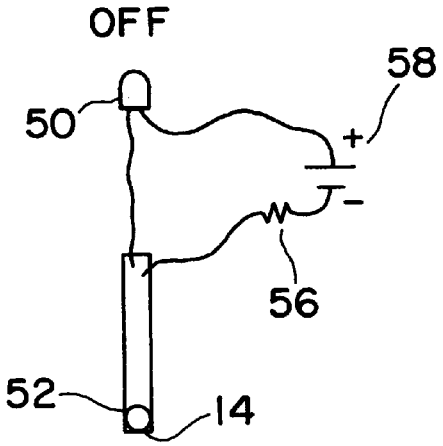
FIG. 4B shows a detailed view of the components of the visual indicator of FIG. 4A.
Figures 2, 4B:
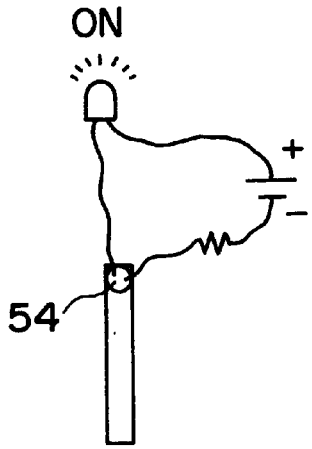
Figure 4A:
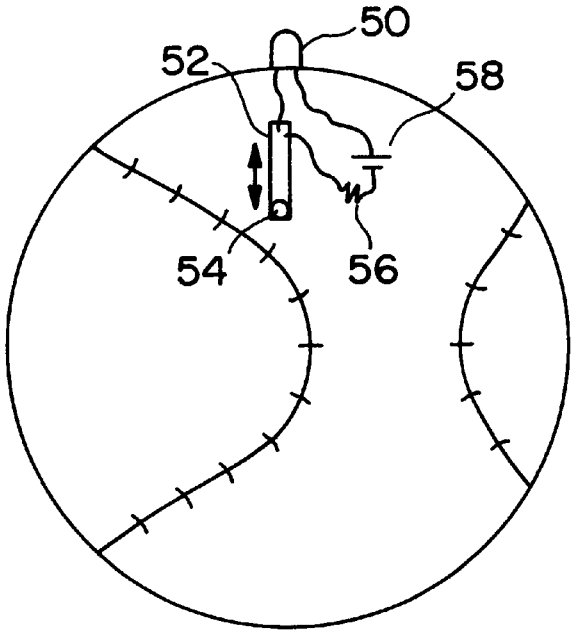
FIG. 4A shows an overall view of another alternative embodiment, namely a visual indicator, in accordance with the present invention.

With reference to FIG. 4, in an alternative embodiment, the audible indication components are replaced by a simple electronic circuit which is completely submerged within the artificial ball. The device consists of a LED 50, mercury switch 52, resistor 56, battery 58, and/or any other similar components which are suitably configured to preform similar functions as the aforementioned known electronic components. Mercury 54 acts like dowel 40 in the preferred embodiment, and allows battery 58 to turn on LED 50 when the athlete's wrist is properly snapped. Alternatively, this device could be mounted externally to allow better view of LED 50. Alternatively, this electronic circuit could also be used to create an audible indication of the wrist snap by simply replacing LED 50 with a speaker or some similarly suited device.

In another alternative embodiment, bolt 18 on first end 14 is attached to an electronic circuit and ring 48 or dowel 40 (depending on the aforementioned embodiment) is attached to the same electronic circuit, such that when ring 48 or dowel 40 impacts bolt 18, the circuit is completed thereby allowing activation of a visual indicator, such as LED 50, attached to the circuit or an audible indicator, such as a speaker, attached to the circuit.

In use, with reference to FIG. 1, the athlete sets upper handles 22 and 24 at a predetermined height for replicating the type of sports ball which the athlete wishes to practice with. For example, an athlete wishing to practice a baseball throw would set upper handles 22, 24 within the notch located at the indicator 32. Cross member 26 would preferably restrict the lower travel of the inner dowel 40 such that the initial location of inner dowel 40 would be parallel with the upper surface of the hand. The athlete would preferably grasp upper handles 22, 24 with four fingers while locating tubular member 12 between any two fingers. The thumb of the athlete would wrap around lower handle 28.

Figure 5:
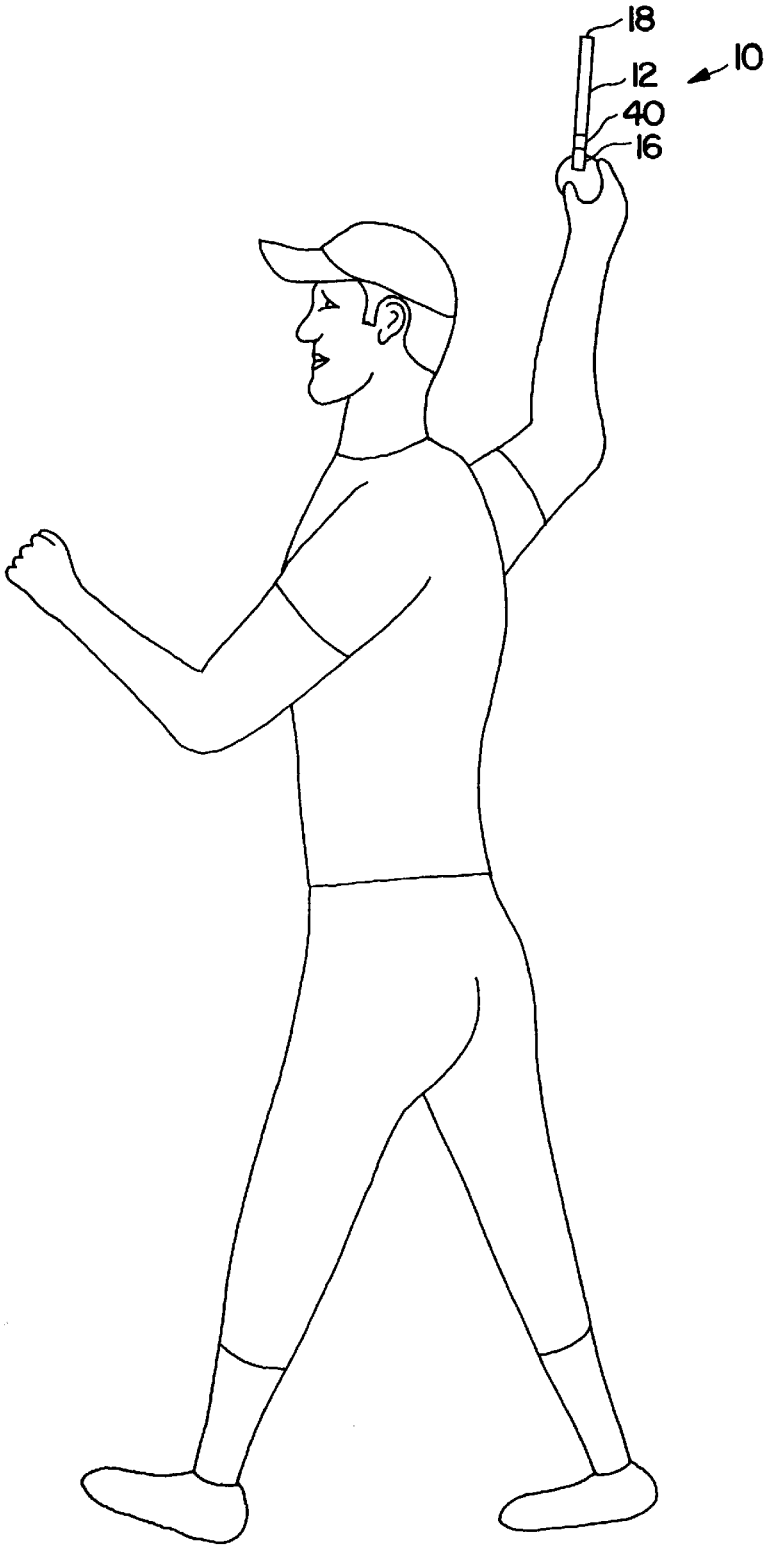
FIG. 5 shows the present invention in use during the beginning of a throwing motion in accordance with the present invention.
Figure 6:
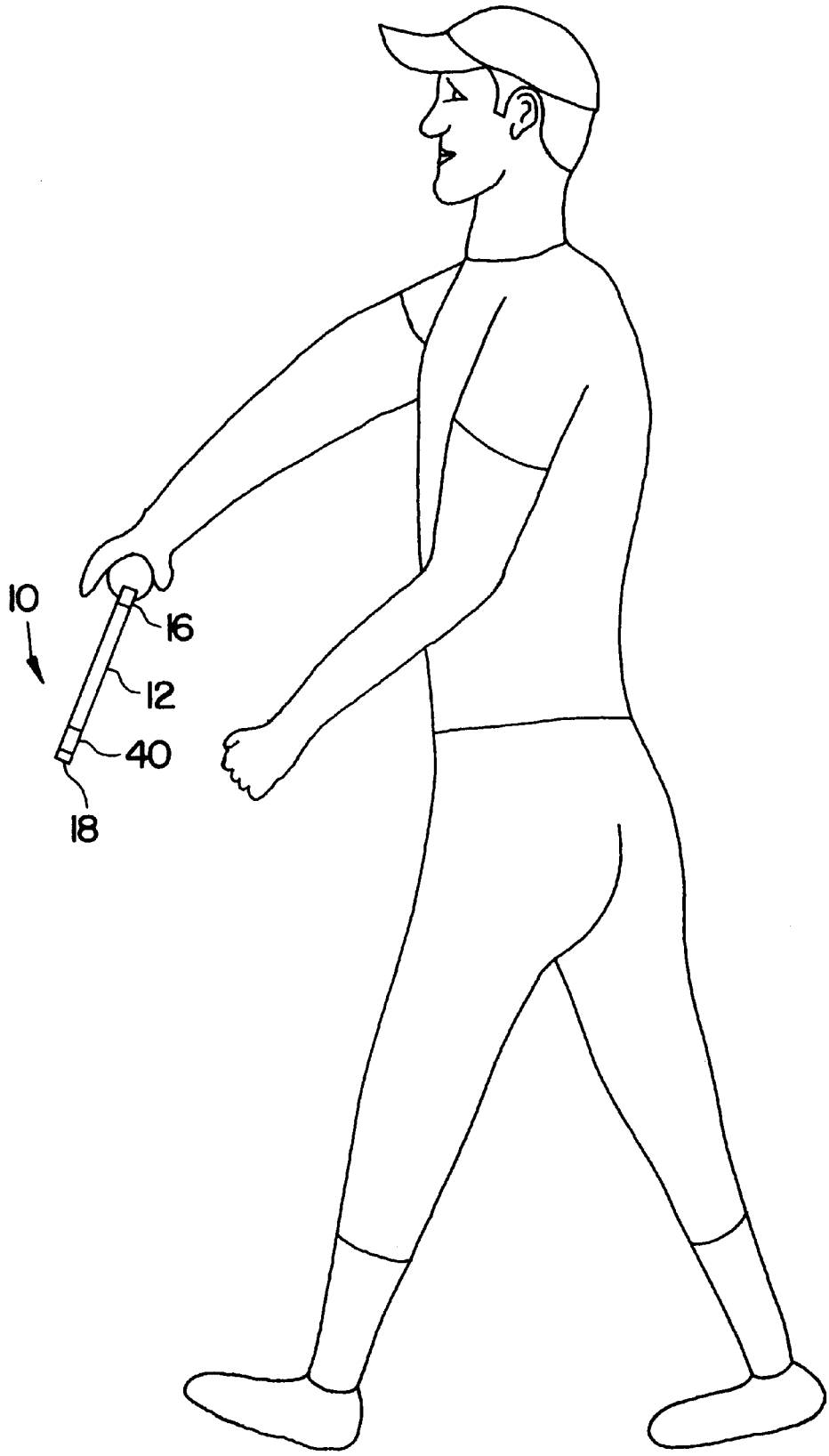
FIG. 6 shows a preferred embodiment of the present invention in use toward the end of a throwing motion in accordance with the present invention.

With reference to FIG. 5 and 6, the athlete would then perform a practice throwing motion by circularly rotating the arm backwards (FIG. 5), then over the head and then forwards in a circular motion (FIG. 6). Alternatively, the softball pitcher would preform a similar motion but in the underhand direction. At the point of replicated ball release (the ball is not released from the athlete's hand in the preferred embodiment), the athlete's wrist snaps downward (or upward in softball), thus causing a centrifugal force to send inner dowel 40 traveling within tubular member 12 toward first end 14 (as best seen in FIG. 6). After inner dowel 40 hits first end 14, inner dowel 40 preferably makes an audible signal indicative of a proper throwing technique. In an alternative embodiment, by incorporating weighted plugs at either ends 14, 16 or by incorporating magnetic inner dowel 40, the effect of the centrifugal force on inner dowel 40 will be either increased or decreased, thus allowing the athlete to control the point at which inner dowel 40 contacts end 14 of tubular member 12. In an alternative embodiment where the electronic device is completely submerged within the artificial ball, such as the one shown in FIG. 4A, it would be possible for the athlete to actually throw the ball when practicing with this device.

While the present invention has been described in conjunction with preferred and alternative embodiments set forth in the drawing figures and the specification, it will be appreciated that the invention is not so limited. For example, other sizes, shapes, materials and components can be incorporated into the device. Various modifications in the selection and arrangement of components and materials may be made without departing from the spirit and scope of the invention as set forth in the appended claims.

I claim:

1. A training device configured to provide an indication of the accuracy of a throwing motion, said device comprising:

an elongated member having a first end and a second end, wherein said first end of said elongated member includes a stopper configured to impact a ring, said stopper being attached to said first end, said stopper being at least one of a bolt, magnet, rubber stopper and beveled portion, a ring circumscribing said elongated member, said ring adapted for longitudinal movement along said elongated member, as upon centrifugal force developed from a throwing motion;

a replicated sports ball substantially located at said second end of said elongated member, said sports ball having a diameter larger than the inside diameter of said ring.

2. The device of claim 1, wherein said replicated sports ball includes at least one of a baseball, softball and football.

3. The device of claim 1, wherein said replicated sports ball includes a bore configured to receive said second end of said elongated member.

4. The device of claim 1, wherein said indication is at least one of audible or visual.

5. A training device configured to provide an indication of the accuracy of a throwing motion, said device comprising:

a replicated sports ball;

an indicating device integral with said sports ball, wherein said indicating device provides at least one of an audible indication and visual indication of said accuracy of said throwing motion.

6. The device of claim 5, wherein said indicating device includes:

an elongated member having a first and a second end;

a ring circumscribing said elongated member, said ring adapted for longitudinal movement along said elongated member, as upon centrifugal force developed from a throwing motion; and, said replicated sports ball substantially located at said second end of said elongated member.

7. The device of claim 6, wherein said first end of said elongated member includes a stopper configured to impact said ring, said stopper being attached to said first end, said stopper being at least one of a bolt, magnet, rubber stopper and beveled portion.

8. The device of claim 6, wherein said stopper is attached to an electronic circuit and said ring is attached to said electronic circuit, such that when said ring impacts said stopper said circuit is completed thereby allowing activation of at least one of a visual indicator attached to said circuit and an audible indicator attached to said circuit.

9. The device of claim 5, wherein said indicating device includes an electronic circuit having a mercury switch.

10. The device of claim 9, wherein said electronic circuit includes at least one of an LED which provides said visual indication and a speaker which provides said audible indication.

11. The device of claim 5, wherein said indicating device includes:

a hollow tubular member having a chamber, a first end and a second end;

a dowel disposed within said chamber of said tubular member, said dowel adapted for longitudinal movement within said chamber, as upon centrifugal force developed from a throwing motion; and, a replicated sports ball attached at said second end of said tubular member.

12. The device of claim 5, wherein said replicated sports ball includes a first handle attached to said elongated member and a second handle attached to said elongated member, at least one of said first and second handles being adjustably attached to said elongated member.

13. A method for providing an indication of the accuracy of a throwing motion, said method comprising:

grasping a replicated sports ball in a user's hand;

practicing a throwing motion with said replicated sports ball;

providing at least one of an audible indication and visual indication of said accuracy of said throwing motion, using an indicating device integral with said sports ball.

14. The method of claim 13, wherein said providing an audible indication step includes providing:

an elongated member having a first and a second end;

a ring circumscribing said elongated member, said ring adapted for longitudinal movement along said elongated member, as upon centrifugal force developed from a throwing motion; and, said replicated sports ball substantially located at said second end of said elongated member.

15. The method of claim 14, wherein said first end of said elongated member includes a stopper configured to impact said ring, said stopper being attached to said first end, said stopper being at least one of a bolt, magnet, rubber stopper and beveled portion.

16. The method of claim 15, wherein said stopper is attached to an electronic circuit and said ring is attached to said electronic circuit, such that when said ring impacts said stopper said circuit is completed thereby allowing activation of at least one of a visual indicator attached to said circuit and an audible indicator attached to said circuit.

17. The method of claim 13, wherein said providing an indication step includes providing an electronic circuit having a mercury switch.

18. The method of claim 17, wherein said electronic circuit includes at least one of an LED which provides said visual indication and a speaker which provides said audible indication.

19. The method of claim 13, wherein said providing an audible indication step includes providing:

a hollow tubular member having a chamber, a first end and a second end;

a dowel disposed within said chamber of said tubular member, said dowel adapted for longitudinal movement within said chamber, as upon centrifugal force developed from a throwing motion; and, a replicated sports ball attached at said second end of said tubular member.

20. The method of claim 13, wherein said step of grasping a replicated sports ball includes grasping a first handle attached to said elongated member and a second handle attached to said elongated member, at least one of said first and second handles being adjustably attached to said elongated member.

* * * * *